US008191182B2

(12) United States Patent
Mauduit

(10) Patent No.: US 8,191,182 B2
(45) Date of Patent: Jun. 5, 2012

(54) HOUSING FOR PROTECTING AND MASKING A TOILET BOWL AND A TOILET BOWL PROVIDED THEREWITH

(76) Inventor: Daniel Mauduit, Mezeray (FR)

( * ) Notice: Subject to any disclaimer, the term of this patent is extended or adjusted under 35 U.S.C. 154(b) by 793 days.

(21) Appl. No.: 12/159,788

(22) PCT Filed: Jan. 2, 2007

(86) PCT No.: PCT/FR2007/000002

§ 371 (c)(1),
(2), (4) Date: Jul. 1, 2008

(87) PCT Pub. No.: WO2007/077390

PCT Pub. Date: Jul. 12, 2007

(65) Prior Publication Data

US 2009/0025132 A1 Jan. 29, 2009

(30) Foreign Application Priority Data

Jan. 2, 2006 (FR) ..... 06 00022

(51) Int. Cl.
*E03D 11/00* (2006.01)

(52) U.S. Cl. ..... 4/420

(58) Field of Classification Search ..... 4/420, 429, 4/440, 443, 300
See application file for complete search history.

(56) References Cited

U.S. PATENT DOCUMENTS

| | | | | |
|---|---|---|---|---|
| 331,993 | A | 12/1885 | Moore | |
| 3,591,868 | A * | 7/1971 | Owens | 4/300 |
| 3,908,202 | A | 9/1975 | Sargent et al. | |
| 4,145,772 | A | 3/1979 | Whitney et al. | |
| 5,231,706 | A * | 8/1993 | Kendall | 4/329 |
| 6,457,188 | B1 * | 10/2002 | Lindberg | 4/420 |

FOREIGN PATENT DOCUMENTS

| | | |
|---|---|---|
| DE | 2 592 077 A1 | 6/1987 |
| DE | 93 09 173 U1 | 8/1993 |
| WO | WO 2005/055792 A1 | 6/2005 |

OTHER PUBLICATIONS

International Search Report completed on Jun. 26, 2007 in International Patent Application No. PCT/FR2007/000002 filed Jan. 2, 2007.

* cited by examiner

*Primary Examiner* — Lori Baker
(74) *Attorney, Agent, or Firm* — Millen, White, Zelano, Branigan, P.C.

(57) ABSTRACT

The invention relates in particular to a housing for protecting and masking a toilet bowl whose top part is provided with a peripheral inwardly folded edge which delimits with the bowl a water distribution channel and which is characterized in that it consists of a body (30) and a cover part (32) which is open in the center thereof, is independent of said body (30) and is arrangeable on the body in such a way that it covers the peripheral edge (11) of the bowl, wherein the body (30) is provided with an anchoring part (5) interacting with the cover part (32) and said anchoring and cover (32) parts comprise complementarily shaped connecting means (51, 330).

9 Claims, 5 Drawing Sheets

HOUSING FOR PROTECTING AND MASKING A TOILET BOWL AND A TOILET BOWL PROVIDED THEREWITH

The present invention relates to a protection and masking housing for a toilet bowl pan.

It also relates to a pan thus equipped.

Toilet bowls are traditionally manufactured from a ceramic material.

Ceramic is a dimensionally unstable material during its manufacturing process. Therefore, the dimensions of the manufactured products are difficult to control and not constant from one item to the next. This is therefore not favourable to the manufacturing of toilet bowl pans in several sub-assemblies to be assembled, nor is it favourable to product variety in terms of shapes.

The advent of new, more lightweight materials which are just as strong as ceramic is likely to change matters. These are notably the materials known as "polymer concretes".

The option has already been considered of "dressing" existing toilet bowl pans, either by masking particularly unsightly technical fixtures (water inlet, etc.) or by making their appearance pleasing to the eye.

The document FR-A-2 592 077 described a hood or housing intended to mask the toilet bowl pan, including covering it up, whereby the upper part of the bowl of the toilet bowl pan is arranged in a peripheral edge and turned down towards the inside.

This hood is composed of a single part, such that its fitting and removal requires a certain level of dexterity.

In addition, such a hood needs to be unmounted whenever a technician wishes to perform work at the rear of the toilet bowl pan itself, in the place where the water inlet and outlet pipes are generally located.

A toilet bowl pan which is easy to install, upkeep and maintain is much sought-after by installers and users. The integration inside the toilet bowl pan of various easily accessible devices, such as an odour aspirator, perfume diffuser, maintenance product diffuser, hand shower, etc., is desirable.

The availability of new materials which are dimensionally stable in manufacturing permits the creation of a modular toilet bowl design by separating the functional part, bowl, cistern, etc., from the shell part in which the ceramic unit is a source of upkeep problems: cleaning of the water distribution channel, etc.

The object of the present invention is to resolve these inconveniences by proposing a housing which is easy to install and remove, which facilitates any intervention, notably technical work at the rear of the toilet bowl pan, but which is completely stable during the normal use of toilets associated with a removable covering part.

A further object is to provide a housing which can be adapted to a toilet bowl pan consisting of several distinct elements.

Thus, it consists of a protection and masking housing of a toilet bowl pan, the upper part of the bowl of which is arranged in a peripheral edge turned down towards the inside, which delimits with this bowl a water distribution channel "R".

This housing is essentially characterized in that:

- it consists of a body and a covering part open in its centre, independent of the body, intended to be positioned over the body and covering the peripheral edge of the toilet bowl pan;
- and said body is equipped with an anchoring part intended to interconnect with said covering part, whereby these anchoring and covering parts have connection means with a complementary shape.

Since the body and the covering part form two distinct parts, it is particularly easy to install and remove them, which permits the handling of the housing without the need for any particular dexterity.

In addition, since the cover and anchoring parts interconnect with each other, they constitute a particularly stable whole.

Another advantage of this structure is that it is modifiable, i.e. certain elements that make it up can be replaced with others, without any repercussions on the functioning of the whole. In particular, the design potential of this toilet bowl pan, due to the possibility of using various stable materials (plastics, composites, stainless steel, wood, etc.) becomes very diverse.

According to other advantageous but non-limiting characteristics:

- viewed from above, the housing has approximately a "U" shape, the wings of which are intended to extend from one side of the toilet bowl pan to the other, and the ends of said wings are linked by a junction element which projects behind and above the upper outline of said body, whereby these junction elements notably form support for said anchoring part;
- said junction element has a suitable surface for coming into contact with a partition wall, with a view to creating a positive connection between it and the latter;
- said anchoring part constitutes the base of a water cistern supplying said toilet bowl pan;
- said anchoring part constitutes the base of a cupboard;
- said connection means with a complementary shape are of the ball joint type;
- said covering part consists of at least one bearing in the shape of a gutter intended to hold at least one trunnion connected to a mobile element such as a flap forming a cover, a toilet seat or a urinal.

The present invention also relates to a toilet bowl pan equipped with a housing according to one of the characteristics listed below.

According to one advantageous characteristic, the peripheral edge turned down towards the inside which, with the bowl, delimits a water distribution channel, constitutes a distinct part of said bowl.

According to a particular embodiment, said edge and said bowl each possess at least one notch intended to be facing each other, as well as a water inlet pipe inserted into the pair of notches.

According to another embodiment, the housing of the toilet bowl pan is supported on an anchoring baseplate and interconnects with said baseplate via a pivot-type link.

Other characteristics and advantages of the invention will be apparent on reading the following detailed description of certain embodiments of the invention. This description, which is not limitative, will be provided with reference to the annexed figures in which:

Figure 1:
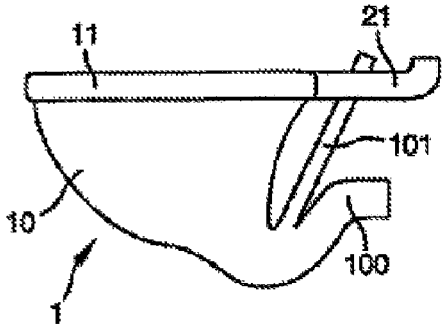
FIG. 1 is a simplified side view of a toilet bowl pan in which the housing according to the invention may be adapted.

The toilet bowl pan shown in FIG. 1 is typical of those which can be fitted with the masking and protection housing according to the invention. It may be manufactured from any suitable material known to the expert in the art, such as "polymer concrete".

This toilet bowl pan 1 usually includes a bowl 10, the upper part of which is arranged in a peripheral edge turned down towards the inside.

Connected to the bottom of the bowl is a wastewater outlet pipe 100 forming a siphon.

Emptying into this pipe is a nozzle 101, the upper end of which extends behind the toilet bowl pan 1, in a slightly higher position than its upper edge. This nozzle is intended, for example, to be fitted with a removable shank, the end of which is equipped with a material that traps tartar. The top of this shank may advantageously be arranged to form a closure plug for the nozzle.

Finally, at least one flexible pipe 21 supplies water to the bowl 10 of the toilet bowl pan 1.

Figure 2:
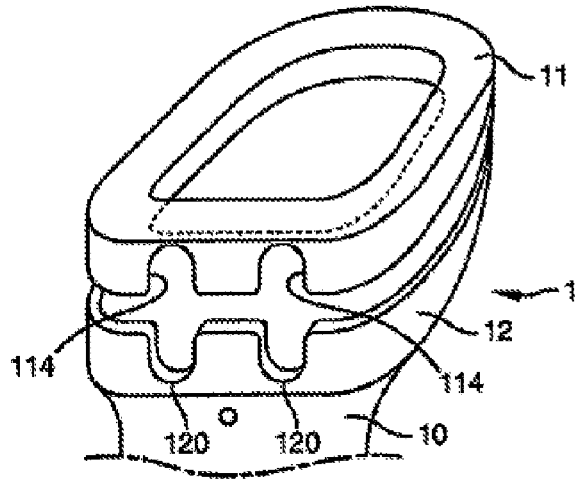
FIG. 2 is a perspective view of the upper rear part of such a toilet bowl pan, provided in the form of a bowl and an edge forming two distinct parts.

FIG. 2 shows a particularly advantageous embodiment of the toilet bowl pan 1.

In fact, the latter consists of a bowl 10 and an edge 11 which are composed of two distinct parts.

Figure 3:
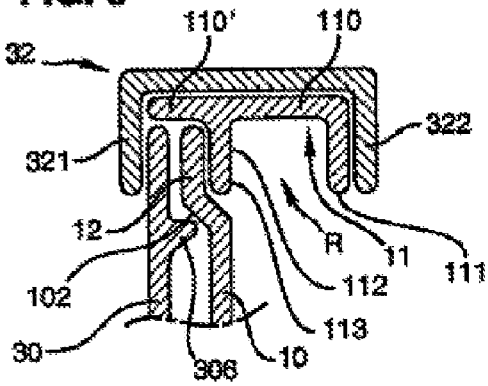
FIG. 3 is a partial sectional view of the bowl and this edge, and is a view intended to show how these two pieces interconnect.

As FIG. 3 shows more precisely, the edge 11 possesses a traditional reverse "U"-shaped structure with a flat base 110 forming the upper support surface and two noticeably parallel wings 111 and 112.

The wing 112 extends into the extension of the wall of the bowl 10, whereas the wing 111 constitutes an internal wall which overhangs the inside of the bowl.

The end 113 of the wing 112 as well as the upper circumference 102 of the bowl are formed in such a way that, by engaging from the top downwards, the edge 11 is supported on the bowl 10 and remains in place. These ends and this circumference here represent retaining walls which engage in complementary fashion. The extension 110' of the edge towards the outside permits the covering of the crown 12 of the bowl 10 and the upper stop 302 of the housing 3, thus ensuring the tightness of the toilet bowl pan/housing couple, in particular when the covering part is removed for cleaning. However, this is just one example. Any other means of interconnection may of course be contemplated.

The edge 11 usually delimits, with the bowl 10, a water distribution channel R inside the toilet bowl pan 1.

As shown in FIG. 2, the edge 11 contains, in its rear part, two notches 114 with a semicircular outline. The same applies to the corresponding region of the wall of the bowl 10. These notches have the reference number 120 and have exactly the same shape as the previous ones, except for the fact that they open in an upward direction.

They are positioned so as to be arranged facing each other, so as to constitute circular openings when the edge 11 is supported on the bowl 1.

Before these two parts are installed one on top of the other, two flexible pipes 21 are engaged in the notches 120, which form part of a water supply part 2 with a common upper section 20.

For this purpose, the ends 210 of the pipes are arranged to be able to engage with the notches and project slightly into the inside of the bowl 10. To that end, lips are provided to ensure perfect water-tightness.

According to another embodiment, a single water pipe exists.

Figure 5:
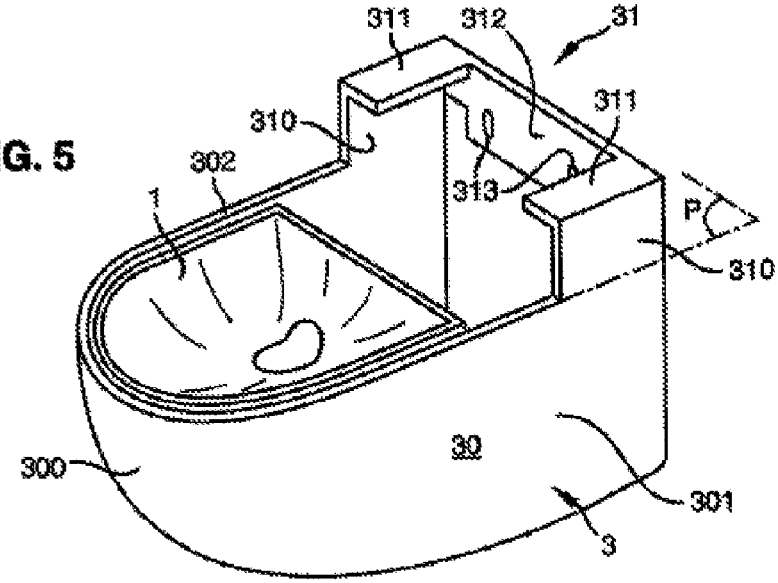
FIG. 5 is a perspective view of a toilet bowl pan equipped with a housing according to the invention, whereby the edge of the toilet bowl pan and the covering part of the housing have been omitted for reasons of simplification of the figure.

The protective housing according to the invention is partly visible in FIG. 5. It is shown in place around a toilet bowl pan 1 of which only the bowl 10 is shown for reasons of simplification.

The body 30 of this housing 3, viewed from above, has approximately a "U" shape, with a curved base 300 which is supported against the front part of the toilet bowl pan 1, and two wings 301 and 302.

This body may possess a particular curved shape, notably to give the desired aesthetic appearance to the overall structure. In other words, the wings 301 and 302 do not necessarily have a strictly vertical orientation when the body 30 is in place.

The two wings 301 and 302 are connected by a junction element 31 which projects backwards and above the upper outline P of the body 30.

More precisely, each wing 301, 302 possesses, adjacent to its free end, a vertical extension 310 which is turned down at a right angle towards the inside to form an outline support 311. In addition, the junction element is equipped with a bottom plate 312, arranged vertically, which is connected to each of the extensions 310 and the outline supports 311. It is noted that this rear assembly constitutes a volume 307 serving as a housing with free dimensions in which the expert in the art may provide for the installation of various equipment (taps, etc.).

The bottom plate 312 constitutes a suitable surface for coming into contact with a partition wall (not shown), with a view to creating a positive connection with it. For this purpose, oblong holes 313 are formed in it and are particularly suited for the insertion of screws.

Figure 7:
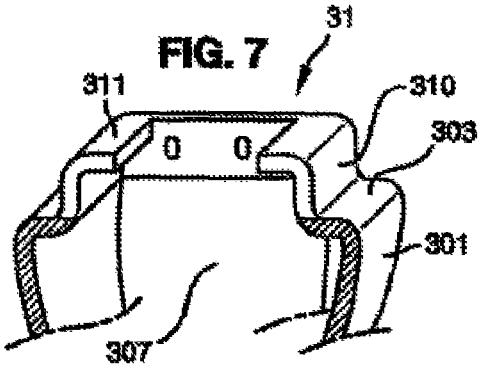
FIG. 7 is a perspective view of the rear part of such a housing.

The body of the housing, partially shown in FIG. 7, possesses largely the same structure as the one already described, except for the fact that the wings 301 and 302 are separated from the vertical extensions 310 by a horizontal surface 303. This reduces the width of the junction element.

Figure 6:
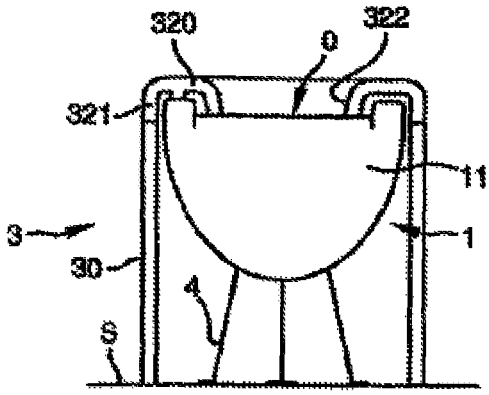
FIG. 6 is a very schematic front elevation view of a toilet bowl pan carried by a tripod, whereby the housing and its covering part are represented in a partial sectional view.

FIG. 6 shows a housing according to the invention which equips a toilet bowl pan resting on a tripod 4.

It is noted that, on the body 30 of the housing 3, a covering part 32 is supported, which possesses an opening O in its centre. This is provided to cover the peripheral edge 11 of the toilet bowl pan. For this purpose, the part 32 possesses a straight section with a reverse "U" shape, with a flat base 320 forming the upper support surface and two noticeably parallel wings 321 and 322. In a preferred embodiment, the "internal" wing 322 may be designed so as to be longer than the "external" wing 321 so as to partially "enter" the bowl 10 of the toilet bowl pan, beyond the lowest point of the edge 11.

The means of interconnection between the body 30 and the covering part may be of the same type as the one in question for the bowl 10 and the edge 11.

Figure 20:
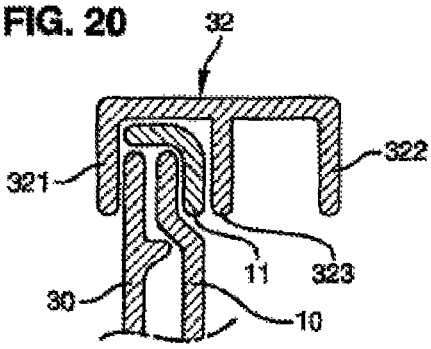
FIG. 20 is a partial sectional view showing, in the case that the bowl 10 is made from ceramic, an interconnection variant of the parts.

According to another embodiment, FIG. 20, when the bowl is manufactured from an unstable material, the edge 11 has a reversed "L" shape and covers the stop 302 of the housing 30. The covering part 32 is equipped with wings 322 and 323 forming a reversed "U", which delimits a water distribution channel "R". The wing 321 provides additional fixation for the covering part and ensures the lateral tightness of the housing 30.

Figure 21:
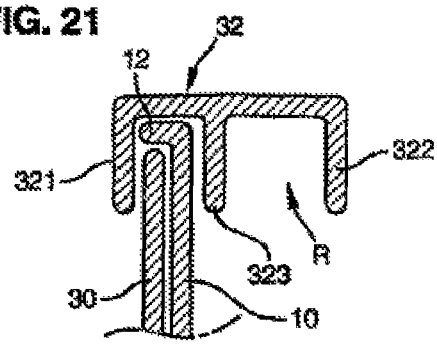
FIG. 21 is a partial sectional view showing, in the case that the bowl is formed from a dimensionally stable material, another interconnection variant of the parts.
Figure 22:
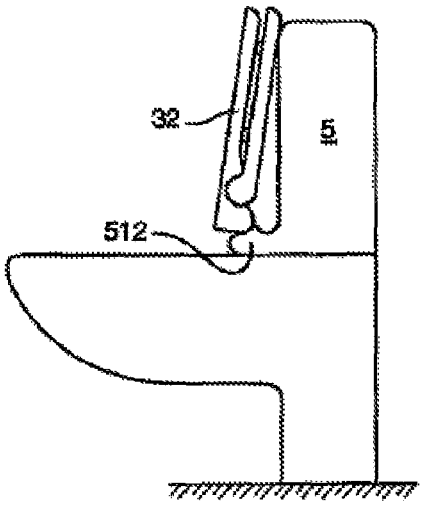
FIG. 22 is an overall view showing the covering part raised and the accessibility created by this inside the part 5.

According to a preferred embodiment, FIG. 21, when the bowl is manufactured from a material permitting the dimensions of the bowl to remain constant, the edge 12 is implemented inside the bowl itself. The edge 12, which has a reversed "L" shape and is oriented towards the outside, covers the stop 302 of the housing.

Figure 4:
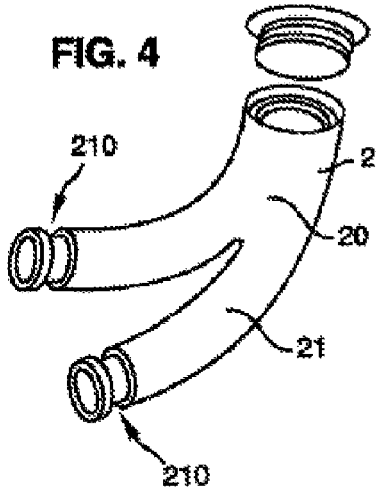
FIG. 4 is a perspective view of a flexible water inlet pipe which is particularly adapted to interconnect with the toilet bowl pan of FIGS. 1 and 2.

When the bowl does not contain any edge part 11, the water pipe is directly connected to the covering part which is then equipped with at least one notch or one orifice. The end 210 of the tube, FIG. 4, is anchored to the toilet bowl pan or a wing of the covering part.

Figure 8:
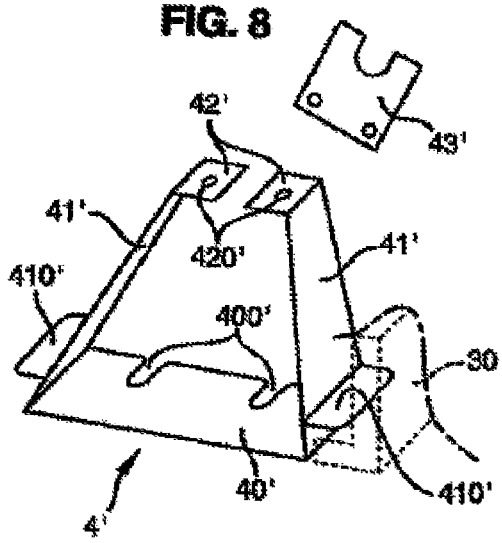
FIG. 8 is a perspective view of an embodiment variant of a support for the toilet bowl pan.

FIG. 8 shows a variant of a toilet bowl pan support. This support 4' consists of a rectangular baseplate 40' intended to rest on the ground. Cuts 400' open onto one of the large sides. They permit the insertion of screws for fixing the plate to the ground.

Extending from the small sides of the baseplate are two identical converging plates 41' forming feet, the top of which is turned down to the horizontal to form support surfaces 42' for the toilet bowl pan. Openings 420' permit the insertion of fixation means such as screws (not shown).

It is noted that the base of the plates 41', on its external side, has a small horizontal leg 410'. This leg constitutes a guide and a stop for the installation of the body 30 of the housing, whereby the lower edge of the latter is formed to slide into place on the leg, thus preventing any movement that would remove the body of the housing in the vertical direction.

The part 43' is a plate which, associated with the support 4, permits the holding of equipment (odour aspirator, etc.).

Figure 23:
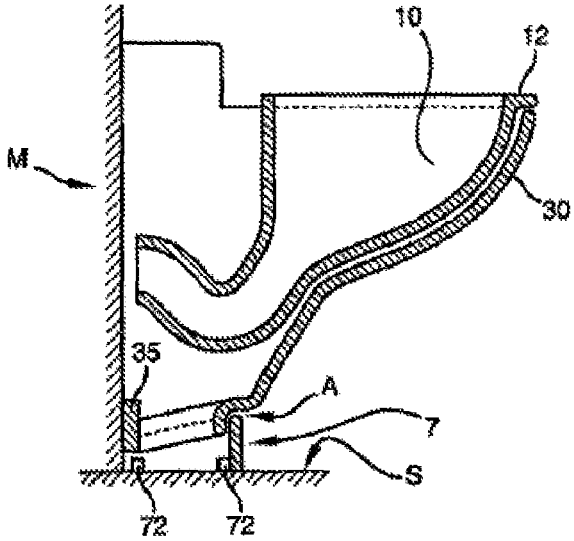
FIG. 23 shows the association of the body of a semi-suspended housing and an anchoring baseplate.
Figure 24:
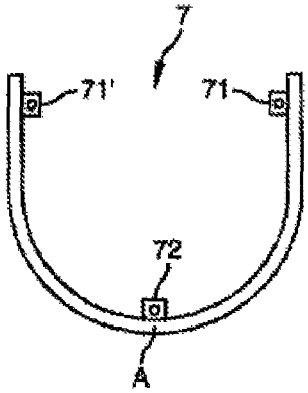
FIG. 24 shows an anchoring baseplate.

According to a preferred embodiment as described in FIG. 23 for a semi-suspended toilet bowl pan, the housing 30 is supported on an anchoring baseplate 7 consisting of a wall with a general semicircular shape viewed from above and a trapezoid shape viewed from the side. This baseplate 7, FIG. 24, is fixed to the ground by feet 71, 71', 72. The housing which is supported on the perimeter of the baseplate is equipped with a continuous or discontinuous lip which penetrates into the baseplate and is in contact with the vertical wall of said baseplate. The housing is equipped with a crossbeam 35, situated on its base, linking the two wings 301, 302. The general semicircular shape of the baseplate, FIG. 24, is only one example of a possible shape.

The geometry of the link between the baseplate and the housing permits the installation of a toilet bowl pan suspended along a dry, plaster-type partition wall.

According to a lever-type geometry effect, the link between the housing and the baseplate at the support point "A" permits the passing on through the dry partition wall "C" by means of the crossbeam 35 of the load of a user seated on the toilet bowl pan; the weight of the user causes a vertical rotation of the toilet bowl pan, the axis of which is said point "A", and this rotation is oriented in an upward direction. The effort on pulling out the partition wall from the part 312, FIG. 5, becomes almost zero, or even zero, due to the load-bearing surface of the crossbeam 35 on said partition wall "C".

According to a preferred embodiment, the crossbeam 35 is equipped with holes for fixation onto the partition wall M. Advantageously, the effort on pulling out occurs essentially in the vertical plane, which is a particularly favourable solution for dry partition walls.

This anchoring baseplate solution has the benefit of permitting easy installation of the toilet bowl pan. If the bowl 10 consists of a dimensionally stable material, its edge 12 is supported on the perimeter of said bowl. If it is made from ceramic, the bowl is supported on the inside of the housing on a continuous or discontinuous stop 306, FIG. 3.

Figure 9:
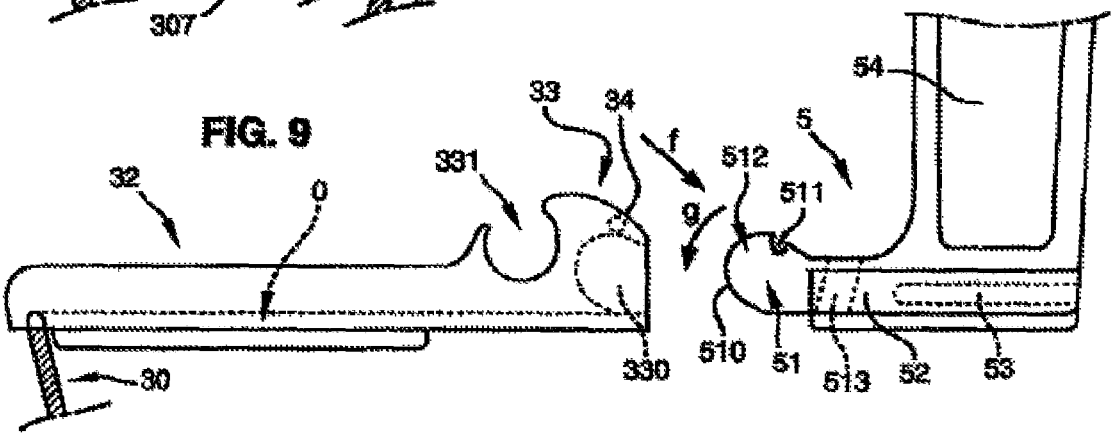
FIG. 9 is an exploded side view of the covering part carried by the housing (partially shown) and the anchoring part which here constitutes the base of a water cistern.

FIG. 9 shows a partial view of the body 30 of the housing, as well as the covering part 32 and an anchoring part 5.

It is noted that, in the rear part of the covering part, beyond its opening O, there extends a massive pad 33.

Transversely and directed upwards, there extends a bearing 331 in the shape of a gutter intended to hold at least one trunnion with a complementary shape, connected to a mobile element such as a flap forming a cover, a toilet seat or a collapsible urinal. This assembly principle is described in application WO-A-2005/055792 and application FR 0601871000 filed in the name of the present applicant.

Also behind this trunnion, there is a housing 330 with a curved profile, the transverse opening of which is oriented towards the rear and in a slightly downward direction.

This housing constitutes a means of connection to an anchoring part 5 which will be described below.

This anchoring part is intended to interconnect with the body 30 of the housing. In the embodiment of FIG. 9, this part constitutes the base of a water cistern 54 intended to supply the toilet bowl pan 1.

With a view to being fixed to the body 30 of the housing, it contains, in its lower part, two vertical partition walls 52, the internal face of which possesses ribbing 53 for its engagement with the body 30.

Figure 11:
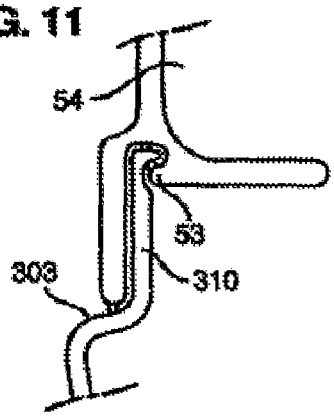

FIG. 11 shows the means of interconnection between the anchoring part and the housing 30; and more precisely with the junction element 31 of the latter, in which the ribbing 53 of the part 5 engages with complementary ribbing of the element 31.

Figure 10:
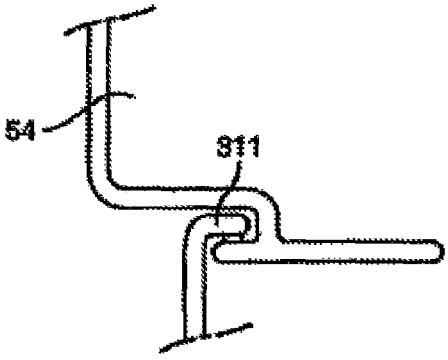
FIGS. 10 and 11 are diagrams showing possible means of interconnection between the housing and the anchoring part.

FIG. 10 shows an embodiment variant of these means of interconnection, in which ribbing and grooves are dispensed with. Here we make use of outline supports 311 which engage with a complementary profile provided in part 5.

Referring once again to FIG. 9, the base of the part 5 is equipped, in its front part, with a massive transverse part 51, the shape of which is strictly complementary, in a close set, to that of the housing 330.

Considering the descending orientation of the latter, i.e. in a slightly downward direction, it is necessary, so as to ensure that the complementary means 330 and 51 can interconnect, to engage the covering part 32 in a direction forming an acute angle to the horizontal (arrow f) then, when the part 51 interconnects with the housing 330, to exert on the part 32 a partial rotation movement in the anticlockwise direction (left arrow) so that it can be supported on the body 30 of the housing.

According to a preferred embodiment, the housing 330, FIG. 9, of the covering part is equipped with a pivot-type block 34 which is inserted into a notch 511 configured in the ball joint 51. The covering part enters into vertical rotation in the axis of the block, which permits the raising of the covering part without detaching it from the part 5. In this construction method, each of the wings 512 is equipped with the same device to support the blocks of the covering part. The housing 330 is supported on the perimeter 510 of the ball joint 51; this envelopment has the effect of preventing any vertical or forward movement of the covering part 32 during the use of the toilet bowl pan. Likewise, the wings 321 and/or 323 and/or 322 prevent any movement of the covering part in the horizontal plane. Secondarily, the covering part permits the fixation in place in front of and behind the part 5 if the latter is not fixed by any other means to the housing or to the wall. This solution permits the easy maintenance of the toilet bowl pan, because the different subassemblies are removable.

Secondarily, the part 5 contains an orifice 513 permitting the insertion of a nozzle 101 associated with the toilet bowl pan.

On reading the above, we understand that it is a question of simple means which permit the immobilization of the various elements of the housing in relation to each other, whereby it is understood that this assembly is reversible, i.e. it is possible to disassemble the covering part or simply lift it up whenever this is desired.

To perfect the stability of the covering part in relation to the housing, and possibly to prevent mischievous people from attempting to disassemble this covering part, the latter may include, in appropriate places, magnets which interconnect with analogous magnets housed in the upper part of the housing body. To be able to remove the covering part, it is then necessary to overcome the resistance force exerted by the magnets, which may be sufficient to dissuade certain mischievous individuals.

Figure 12:
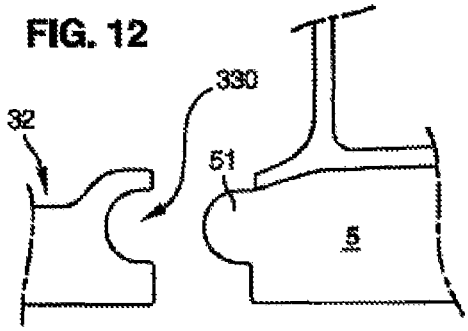
FIG. 12 is a partial side view of the covering part and the anchoring part, equipped with connection means with a complementary shape, different from those shown in FIG. 9.

In FIG. 9, the connection means (51, 330) with a complementary shape possess a curved contact surface of the ball-joint type. In the embodiment shown in FIG. 12, as in FIG. 9, the housings 330 and the massive part 51 also possess a curved profile; however, their orientation is strictly horizontal, such that their mutual engagement/disengagement also occurs in a horizontal direction.

Figure 13:
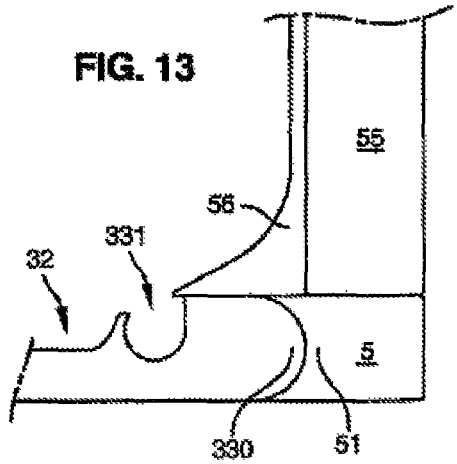
FIG. 13 is another partial side view of the covering part and the anchoring part, whereby the latter constitutes the base of a cupboard.

In the embodiment shown in FIG. 13, the anchoring part 5 constitutes the base of a cupboard 55, the door 56 of which, in the closed position, is profiled so as to partially close the bearing 331 which was referred to in FIG. 9. The above-mentioned international patent application may be referred to for information about the utility of such a structure. Inside this cupboard, a cistern is installed. This cistern is independent of the anchoring part 5. This independent cistern can equip the different housing solutions.

Contrary to the embodiments of the previous figures, the connection means with a complementary shape 330 and 51 respectively consist of a massive part and a housing, both of which have a horizontal orientation.

Figure 14:
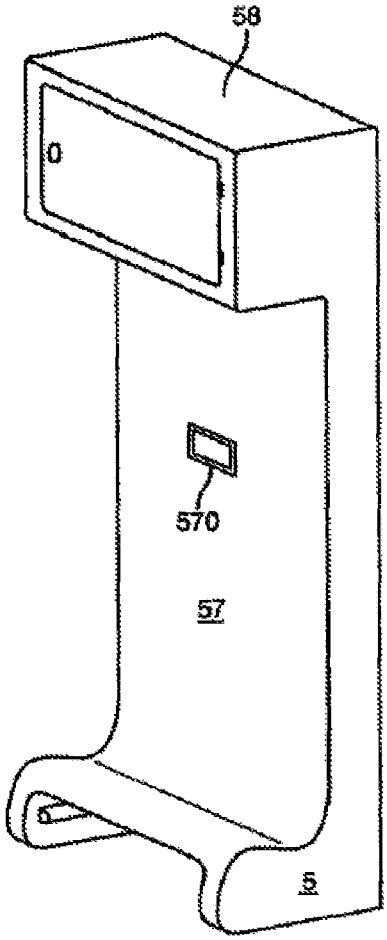
FIG. 14 is a principle view and side view of toilets equipped with a housing according to the invention, in which the anchoring part forms the base of a cupboard which is built into a partition wall.

With reference to FIG. 14, the anchoring part 5 constitutes the base of a column 57 of small thickness, the upper part of which is formed into a storage compartment 58.

The column may include means 570 aiming to detect the presence or absence of a person on the toilets, in particular with a view to automatically actuating the release of a water flush. The compartment may be used as a store for maintenance products. If necessary, the cisterns containing them are linked to flexible tubes housed in the column, the lower end of the distribution of which empties into the toilet bowl pan 1.

Figure 15:
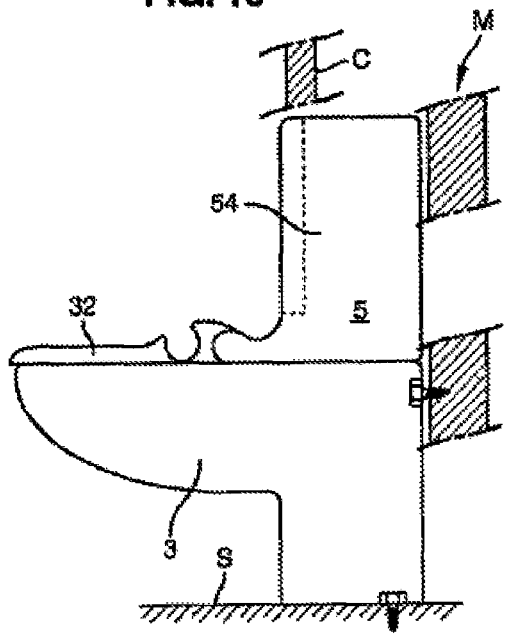
FIG. 15 is a side view of the housing fixed to a ground and a wall.

FIG. 15 shows an embodiment variant; the housing 3 inserted into a partition wall C is fixed both to the ground S and to a wall M, such that the cistern 54 (not shown in the figure) is built into the space separating them.

Figure 16:
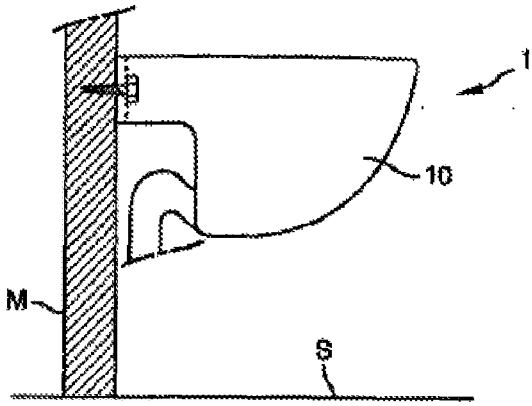
FIG. 16 is a view of the toilet bowl pan of so-called suspended toilets.

FIG. 16 is a schematic representation of a toilet bowl pan 1 known as a suspended toilet bowl pan. In a manner which is known in itself, it is a toilet bowl pan lacking a pedestal to support it on the ground.

It is exclusively fixed, by appropriate means, to the wall M. For this purpose, associated dowels and screws may be used. It is also possible to use a plate previously fixed to the wall and equipped with hitching bodies, on which the toilet bowl pan is positioned, whereby the latter possesses means of interconnection which engage with the means of hitching.

Although this structure is perfectly stable, the absence of a support pedestal on the ground provokes a mitigated reaction among certain users who fear that the toilet bowl pan will become detached from the wall and fall on the ground.

Figure 17:
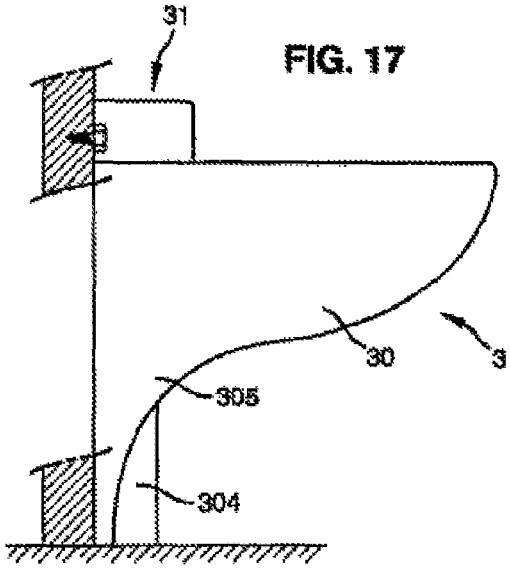
FIGS. 17 and 18 are side views and front elevation views of the body of a housing provided to protect and mask a toilet bowl pan such as that shown in FIG. 16.
Figure 18:
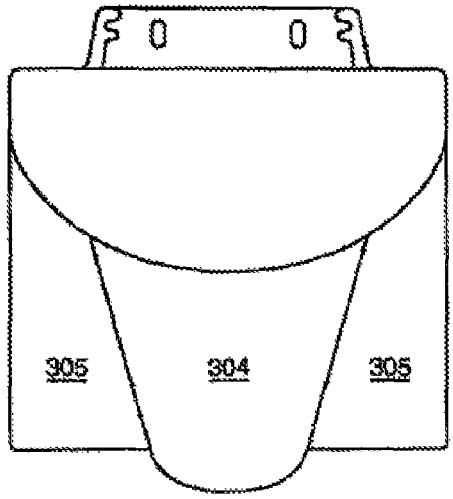

The housing shown in FIGS. 17 and 18 permits the protection and masking of this toilet bowl pan by means of the wings 305, by creating the illusion that it consists of a floor-supported pedestal.

For this purpose, this housing 3 consists of a curved body, the shape of which is adapted to match with that of the toilet bowl pan, whereby its lower part consists of a central zone 304 which is noticeable vertical and rounded and is intended notably to mask the pipework system associated with the toilet bowl pan. It is precisely this central zone 304 which creates the illusion that the toilet bowl pan is resting on the ground S.

Figure 19:
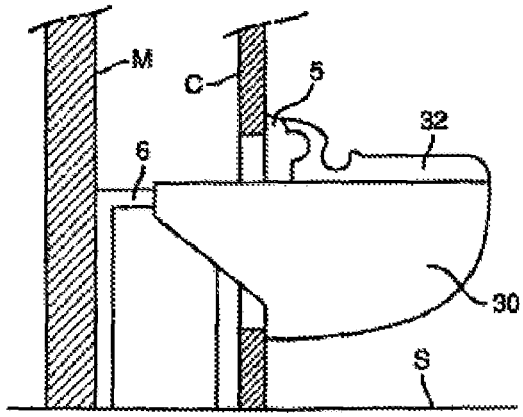
FIG. 19 is a simplified side view of an embodiment variant of toilets provided with a housing according to the invention, in which the toilet bowl pan and the connected to a framework placed between the wall and a partition wall.

With reference to FIG. 19, it is a question of a framework 6, for example a metal framework, which is housed in a space between a wall M and a partition wall C.

This framework is preferably fixed to the wall M and/or to the ground by any appropriate means.

This framework serves as a fixation support for the toilet bowl pan (not visible on the figure), as well as for the body 30 of the housing 3.

In the example shown, the housing is partially engaged with the space between the wall M and the partition wall C. Of course, the partition wall possesses an opening of appropriate dimensions.

The fixation of the toilet bowl pan and the body 30 of the housing is effected by any appropriate means, such as screws, runners, etc. Technical solutions permitting the easy disassembly of the elements are preferably used.

The framework 6 may constitute a means of support for a water distribution cistern not shown, which it is sufficient to connect, for example by means of flexible pipes, firstly to the supply network and secondly to the toilet bowl pan.

Although it has not been shown on the figures, the housing according to the invention, and more particularly its covering part, may be equipped with additional equipment, notably intended to enhance the comfort of the user. As already proposed in the above-mentioned international application, the covering part 32, when associated with a flap, may contain means of automatic triggering of the water flush, notably of an electronic type.

Also possibly provided in this part are housings for holding removable armrest arms, intended to facilitate the movement of the toilet user into a standing position. Preferably, the upper surface of the part 32 consists of appropriate surfaces to hold support elements connected to the armrests, when the latter are in the turned-down and horizontal position.

The structure of the housing according to the invention permits the protection and masking of a toilet bowl pan, regardless of the configuration.

As is apparent from the description above, it is particularly easy to disassemble. The removal of the covering part and the anchoring part permits most particularly the obtainment of access to the rear part of the toilet bowl pan, either for the maintenance of the latter, or to gain access to the complementary equipment housed there.

Of the installation of the toilet bowl pan becomes easy, it may be that some such installations may be performed against fragile walls; in this case, the person skilled in the art uses connection means such as angle brackets connected to the ground and/or connected to the anchoring baseplate, which are associated with the crossbeam 35 of the housing. This solution merely constitutes one variant.

The invention claimed is:

1. A protection and masking housing for a toilet bowl pan having a peripheral edge at the upper part that defines a water distribution channel comprising:

a body (30) and a removable by disengagement covering part (32) open in its center, independent of said body (30), positioned on said body, and configured to cover the peripheral edge (11) of a toilet bowl pan;

wherein said body (30) is equipped with an anchoring part (5) which reversibly interconnects with said removable covering part (32), wherein said connection (51, 330) comprises a ball-joint and corresponding bearing with a complementary curved shape and wherein the covering part (32) is equipped with a pivot-type block (34) which when inserted into a notch (511) configured in the ball joint (51), allows the covering part (32) to enter into vertical rotation in the axis of the pivot-type block (34) and when not inserted allows for the removal of the covering part (32) by vertical rotation in the axis of the pivot-type block (34) until disengagement.

2. A housing according to claim 1, wherein said housing is approximately a "U" shape, wherein two wings (301) extend from one side of the toilet bowl pan (1) to the other, wherein the ends of said wings are linked by a junction element (31) which may project above the upper outline (P) of said body (30), whereby this junction element (31) forms a support for said anchoring part (5).

3. A housing according to claim 2, wherein said junction element (31) has a surface (312) capable of coming into contact with a partition wall to creating a connection between said junction element and said partition wall.

4. A housing according to claim 1, wherein said anchoring part (5) constitutes the base of a water cistern (54) supplying said toilet bowl pan (1) and/or a cupboard (55).

5. A housing according to claim 1, wherein said housing 30 is supported on a trapezoid anchoring baseplate (7).

6. A housing according to claim 1, wherein said covering part (32) has at least one bearing (331) in the shape of a gutter.

7. An assembly consisting of:

a toilet bowl pan, with a peripheral edge (11), which interconnects with a housing according to claim 1.

8. An assembly according to claim 7, wherein said edge (11) constitutes a distinctive part of said bowl (10).

9. An assembly according to claim 8, wherein said edge (11) and said bowl (10) each possess at least one notch (114, 120) positioned facing each other, when connected, and a water inlet pipe (210) inserted into the pair of notches.

* * * * *